US008051796B2

(12) United States Patent
Clifford

(10) Patent No.: US 8,051,796 B2
(45) **Date of Patent: *Nov. 8, 2011**

(54) ROBOTIC APPARATUS AND METHOD FOR PAINTING

(75) Inventor: Scott J. Clifford, Rochester Hills, MI (US)

(73) Assignee: Fanuc Robotics America, Inc., Rochester Hills, MI (US)

( * ) Notice: Subject to any disclaimer, the term of this patent is extended or adjusted under 35 U.S.C. 154(b) by 511 days.

This patent is subject to a terminal disclaimer.

(21) Appl. No.: 12/187,663

(22) Filed: Aug. 7, 2008

(65) Prior Publication Data

US 2009/0017212 A1 Jan. 15, 2009

Related U.S. Application Data

(63) Continuation-in-part of application No. 11/872,372, filed on Oct. 15, 2007, now Pat. No. 7,638,000, which is a continuation of application No. 10/691,939, filed on Oct. 23, 2003, now Pat. No. 7,399,363.

(60) Provisional application No. 60/955,170, filed on Aug. 10, 2007.

(51) Int. Cl.
*B05B 3/00* (2006.01)
*B05B 5/00* (2006.01)

(52) U.S. Cl. ..... 118/323; 118/620; 118/629; 118/326; 901/45; 901/29

(58) Field of Classification Search ..... 118/323, 118/620, 629, 326, 321, 302; 901/43, 15, 901/27, 29, 41, 49, 50; 138/121, 109, 120; 239/690, 690.1, 750–752; 427/427.2, 427.3
See application file for complete search history.

(56) References Cited

U.S. PATENT DOCUMENTS

| | | | | |
|---|---|---|---|---|
| 2,930,350 | A | 3/1960 | Gengenbach et al. | |
| 4,614,300 | A * | 9/1986 | Falcoff | 239/71 |
| 4,712,739 | A | 12/1987 | Bihn | |
| 5,293,911 | A | 3/1994 | Akeel | |
| 5,320,283 | A | 6/1994 | Hollstein et al. | |
| 5,367,944 | A | 11/1994 | Akeel et al. | |
| 5,536,315 | A | 7/1996 | Guzowski et al. | |
| 6,455,097 | B1 * | 9/2002 | Berclaz et al. | 427/8 |
| 6,544,336 | B1 * | 4/2003 | Lopes | 118/302 |
| 6,776,843 | B2 * | 8/2004 | Fouvet et al. | 118/323 |
| 7,328,862 | B2 | 2/2008 | Takebe et al. | |
| 7,638,000 | B2 * | 12/2009 | Clifford et al. | 118/323 |
| 2001/0013315 | A1 | 8/2001 | Klein et al. | |
| 2004/0115360 | A1 | 6/2004 | Clifford et al. | |

FOREIGN PATENT DOCUMENTS

| | | | |
|---|---|---|---|
| JP | 11267560 | A | 10/1999 |

* cited by examiner

*Primary Examiner* — Yewebdar Tadesse
(74) *Attorney, Agent, or Firm* — Fraser Clemens Martin & Miller LLC; William J. Clemens

(57) ABSTRACT

A robotic painting system includes a device for generating a vacuum and a dump line disposed upstream from a connection between an isolation line and a canister, wherein the device for generating a vacuum and the dump line are employed for filling and cleaning the robotic painting system.

19 Claims, 6 Drawing Sheets

ROBOTIC APPARATUS AND METHOD FOR PAINTING

CROSS-REFERENCE TO RELATED APPLICATION

This application is a continuation-in-part of the U.S. patent application Ser. No. 11/872,372 filed Oct. 15, 2007, now U.S. Pat. No. 7,638,000 issued Dec. 29. 2009, which is a continuation of U.S. patent application Ser. No. 10/691,939 filed Oct. 23, 2003, now U.S. Pat. No. 7,399,363 issued Jul. 15, 2008.

This application claims the benefit of U.S. provisional patent application Ser. No. 60/955,170 filed Aug. 10, 2007.

FIELD OF THE INVENTION

The present invention relates to a robotic painting system for applying electrically conductive paint to an external surface of an automotive vehicle body, and more particularly to a robotic painting system and a method for filling and cleaning the same.

BACKGROUND OF THE INVENTION

Prior art paint booths are well known. A typical prior art paint booth for painting an exterior surface of a vehicle body in a continuous conveyance and stop station system includes an enclosure housing and a plurality of paint applicators. In one configuration, the applicators are mounted on an inverted U-shaped support structure that includes two vertical supports, one on either side of the path of travel of the vehicle body, and connected at a top thereof by a horizontal support structure. The support structure facilitates painting of a top surface of the vehicle body, and the horizontal beam can be fixed or have an additional degree of freedom to move along the top surface of the vehicle body being painted. Another painting device is used in the same painting zone to paint sides of the vehicle body, and generally is not capable of moving laterally along the length of the vehicle body. Disadvantages of this type of painting apparatus include lack of flexibility to provide optimized standoff distance between the vehicle body surface and the applicator, and inefficient use of the allotted painting cycle time. The paint applicators of the painting devices adapted to paint the top surface of the vehicle are mounted on a common beam. Therefore, the distance between each paint applicator and the surface to be painted varies with the contours of the vehicle body. The paint applicators of the painting devices adapted to paint the sides of the vehicle include applicators that do not move transverse to the path of the vehicle body. Accordingly, the paint applicators can only paint a portion of the vehicle body that is in front of the applicator, leaving a substantial portion of the available cycle time unused.

A more recent alternative to the support structure is a floor-mounted robot disposed along the sides of the paint booth. The robots include spray guns or rotary applicators (bell machines) mounted thereon for directing atomized paint toward the vehicle body. While rotary applicators have advantages over spray guns, there are some associated disadvantages. The prior art floor mounted robot, especially robots having rotary applicators, are costly and limit visual access to the spray booth. The bell machines require more bells for the same throughput due to limited orientation capability. The additional bells use more paint per vehicle due to the waste generated by each bell during a paint color changing operation. Prior art floor mounted robots also require significant booth modification when installed in existing paint booths, thereby increasing installation time and cost, and requiring more floor space within the paint booth. The rail axis of floor mounted robot requires doors at both ends of the paint booth. The waist axis of the floor mounted robot requires an additional safety zone at the ends of the spray booth, and the rail cabinets of the floor mounted robot encroach into aisle space. The floor mounted robot also requires frequent cleaning due to a down draft of paint overspray causing paint accumulation on the robot arm and base, which results in higher maintenance and cleaning costs.

Due to the conductivity of the waterborne paint, it is necessary to electrically isolate the grounded bulk paint supply system from a charged local dispensing canister and spray application system. In the prior art, the bell applicator, canister, canister drive, electrostatic cascade, and docking interface were all integrated into a single unit mounted on the robot wrist as shown in U.S. Pat. No. 5,293,911 and U.S. Pat. No. 5,367,944. Such an applicator has the following shortcomings: 1) the applicator is heavy, expensive, and subject to damage via collision with objects in the painting booth; 2) the applicator docking with a docking station must occur in a fixed booth position which limits process flexibility; 3) the docking process takes cycle time as the robot must travel to and from the docked position, and the canister filling cannot start until the applicator reaches the docked position; and 4) the docking hardware is expensive and unique to waterborne systems.

To prepare the robot for a painting operation, the canister must be filled with paint. To fill the canister with paint, a piston slidably disposed in the canister is drawn away from the cylinder bottom and an applicator valve is opened, thereby introducing a small amount of air into the canister. The paint is then caused to flow from a selected color valve, through an isolation line, and into the canister. As the initial volume of the canister is filled through a trigger passage of the applicator, air is pushed out of the system through the applicator until the paint reaches a restriction in the trigger passage. The restriction causes an increase in the fluid pressure in the canister due to the viscosity difference between the paint and the air being displaced by the paint. The pressure increase causes a torque applied by a drive motor to increase, which can be sensed and used to adjust the rate of filling of the canister. Once the canister and applicator are filled, air in the canister is removed. To remove the air from the canister, an amount of air and paint is expelled from the canister through the applicator until the air is removed, thereby wasting the amount of paint expelled. Another filling operation known as the pressure based fill through injector tip mode of filling the canister utilizes the torque feedback to determine when the paint will fill the canister. A single torque feedback value is typically used for the filling operation of each of the colors. However, because the viscosities and bulk pressure of the paints vary from color to color, time based filling operations may lead to wasted paint (time too long) or an improperly filled system (time too short).

The piston may be utilized to optimize the canister fill operation time. First, if the fill rate of paint into the canister is known or can be automatically measured, the rate at which the canister piston mechanism is drawn away from the canister bottom may be adjusted to minimize the pressure drop of the incoming paint, and decrease the fill time. The fill rate may be sensed by measuring either servo error (positive or negative) or motor torque feedback applied to the piston. Second, the piston may be drawn away from the canister bottom at a rate known to be slightly below the system fill rate. However, as the paint rapidly fills the canister, air may become entrapped in the canister and mixed with the paint.

The grounded bulk paint supply must be isolated from charged system components to militate against voltage leakage and electrostatic erosion. A method to isolate the bulk paint supply system from the charged paint dispensing canister is to clean and dry the paint transfer line between the supply system and the canister. In an automotive-type painting system (rapid color changing on a continuous conveyance type system), a dump line is typically connected to and in fluid communication with the bell applicator or other portion of the system downstream from the canister. When cleaning the interior of the canister, the piston is drawn away from the canister bottom. The piston is cycled in and out of the canister as a solvent and air mixture is introduced into the canister to facilitate effective cleaning of the area between the piston and the bottom of the canister. Simultaneous to the cleaning of the canister with a solvent and air mixture, a paint line from the canister to the applicator is backflushed. As the piston cycles and is caused to slidably enter the canister toward the applicator, the solvent and air mixture is forced out of the canister and through the dump line. After canister cleaning, the system is ready to be filled with a different color of paint.

This method of cleaning the robot has numerous shortcomings, including: 1) a time to clean and dry the line and provide high voltage isolation exceeds the allotted dwell time between the vehicle bodies being painted; 2) paint residue remaining on the walls of the transfer line, the dump line, or the interior of the canister may lead to a high voltage leakage causing electrostatic erosion that may burn holes in the transfer line, the dispensing system, the supply line to the applicator, or the waste collection lines; 3) an amount of waste that is left in the paint transfer line is excessive when compared to other means of isolation; and 4) because the solvent and air mixture containing paint residues is caused to flow through the dump line downstream from the solvent and air mixture input, paint residue may remain at the connection between the dump line and the canister.

It would be desirable to provide a robotic painting system and method for filling and cleaning the same, wherein the air in the painting system during the filling operation is minimized and the cleaning operation of the system is optimized.

SUMMARY OF THE INVENTION

Concordant and congruous with the present invention, a robotic painting system and method for filling and cleaning the same, wherein the air in the painting system during the filling operation is minimized and the cleaning operation of the system is optimized, has surprisingly been discovered.

In one embodiment, the painting system comprises an arm adapted for use with a painting robot, the arm having a housing formed of a non-conductive material; a color changer in fluid communication with a paint supply; a canister disposed in the housing and including an inlet and an outlet; an isolation line providing fluid communication between the color changer and the canister; a means for generating a vacuum in the canister; and a dump line in fluid communication with the canister upstream of a connection between the isolation line and the canister.

In another embodiment, the method of operating a robotic painting system comprises the steps of providing a color changer in fluid communication with a paint supply; providing a canister in fluid communication with an applicator; providing an isolation line providing fluid communication between the color changer and the canister; providing a dump line in fluid communication with the canister upstream of the connection between the isolation line and the canister; generating a vacuum in the canister; filling the canister with a desired amount of paint by causing the paint to flow from the color changer to the canister; performing a painting operation by dispensing the paint from the canister; introducing a solvent and air mixture to the canister through the color changer; and cleaning the canister and isolation line by removing the solvent and air mixture from the canister through the dump line.

In another embodiment, the method of operating a robotic painting system comprises the steps of providing a color changer in fluid communication with a paint supply; providing a canister in fluid communication with an applicator; providing a piston slidably disposed in the canister; providing an isolation line providing fluid communication between the color changer and the canister; providing a dump line in fluid communication with the canister upstream of the connection between the isolation line and the canister; generating a vacuum in the canister; filling the canister with a desired amount of paint by causing the paint to flow from the color changer to the canister; performing a painting operation by dispensing the paint from the canister; introducing a solvent and air mixture to the canister through the color changer; and cleaning the canister and isolation line by removing the solvent and air mixture from the canister through the dump line.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE EMBODIMENTS

The U.S. patent application Ser. No. 11/872,372 filed Oct. 15, 2007, now U.S. Pat. No. 7,638,000 issued Dec. 29, 2009, the U.S. patent application Ser. No. 10/691,939 filed Oct. 23, 2003, now U.S. Pat. No. 7,399,363 issued Jul. 15, 2008, and the U.S. provisional patent application Ser. No. 60/955,170 filed Aug. 10, 2007 are hereby incorporated herein by reference.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
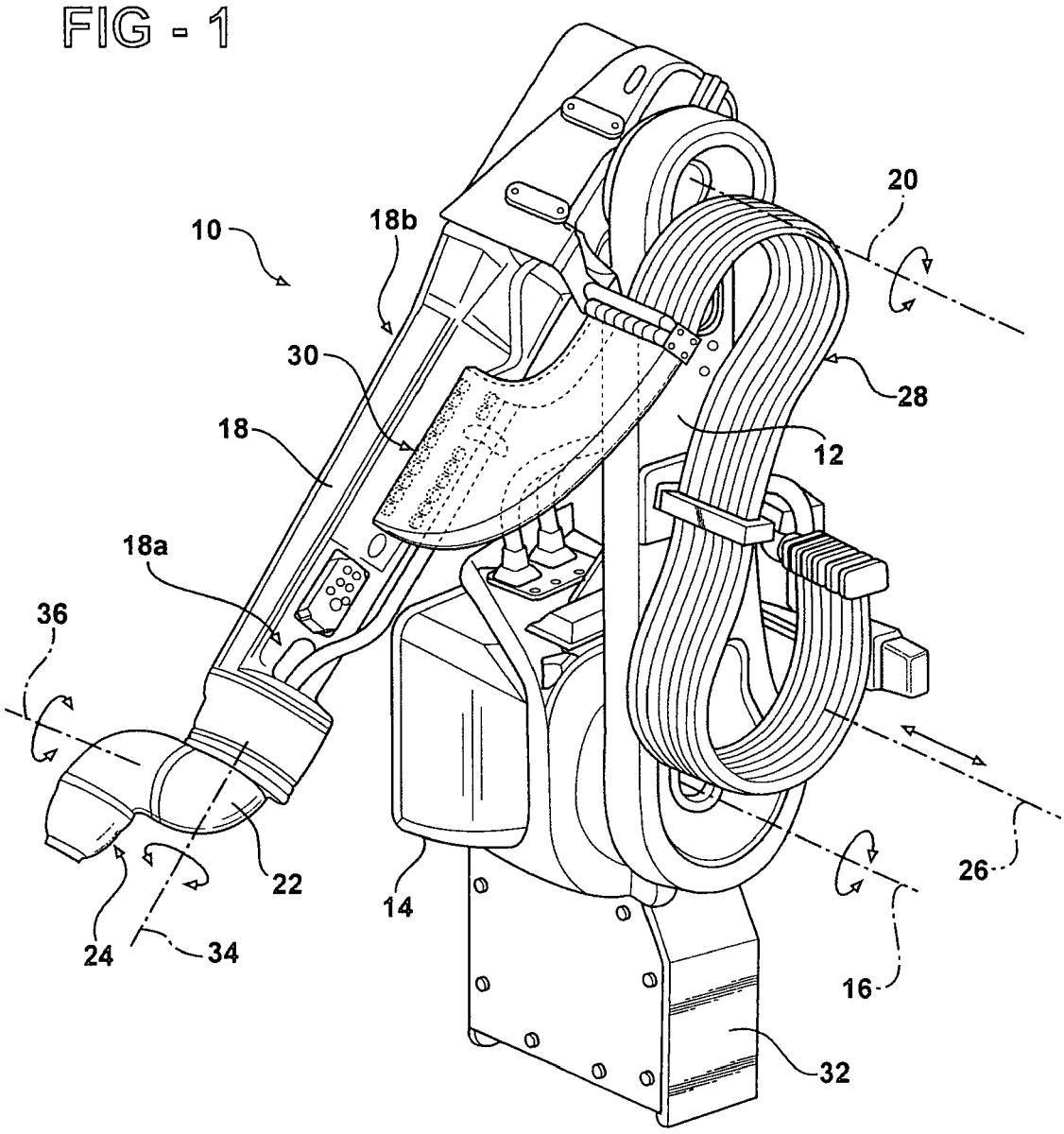
FIG. 1 is a perspective view of a painting robot according to an embodiment of the invention.

FIG. 1 illustrates a robot painting system 10 according an embodiment of the invention. The painting system 10 includes an inner arm 12 and an outer arm 18. The painting system 10 provides four axes of motion 16, 20, 34, 36 relative to a base 14 for respective pivotal movement of the inner arm 12, the outer arm 18, a wrist 22, and an applicator 24. Mounting the robot base 14 to a frame system may provide a fifth axis of motion 26 longitudinally along an axis of the frame system (not shown). It is understood that any number of the painting system 10 may cooperate with or be mounted to the frame system to facilitate optimal painting of a vehicle.

The inner arm 12 is mounted to the robot base 14 for rotation about the shoulder axis 16, and includes a plurality of paint lines 28. The paint lines 28 are connected to a first side of the inner arm 12 and provide fluid communication between a bulk supply of paint (not shown) and a color changer 30 of the outer arm 18. The robot base 14 includes a process control enclosure 32 which includes pneumatic valves and control components (not shown) adapted to adjust and move the painting system 10.

The outer arm 18 includes the first side 18*a*, a second side 18*b*, and the wrist 22. A first end of the outer arm 18 is mounted to a second end of the inner arm 12 for rotation about the elbow axis 20. The outer arm 18 is formed from a non-conductive material having suitable structural strength and is substantially impervious to the corrosive properties of solvents used in the painting process. An example of such a material is Lauramid A material. "Lauramid" is a registered trademark of Albert Handtmann ELTEKA Verwaltungs-GmbH of Biberach, Germany. Lauramid A material is a castable polyamide Nylon 12G material that also provides for electrostatic isolation, cleanliness, cleaning capability, and weight advantages.

Figures 2, 4:
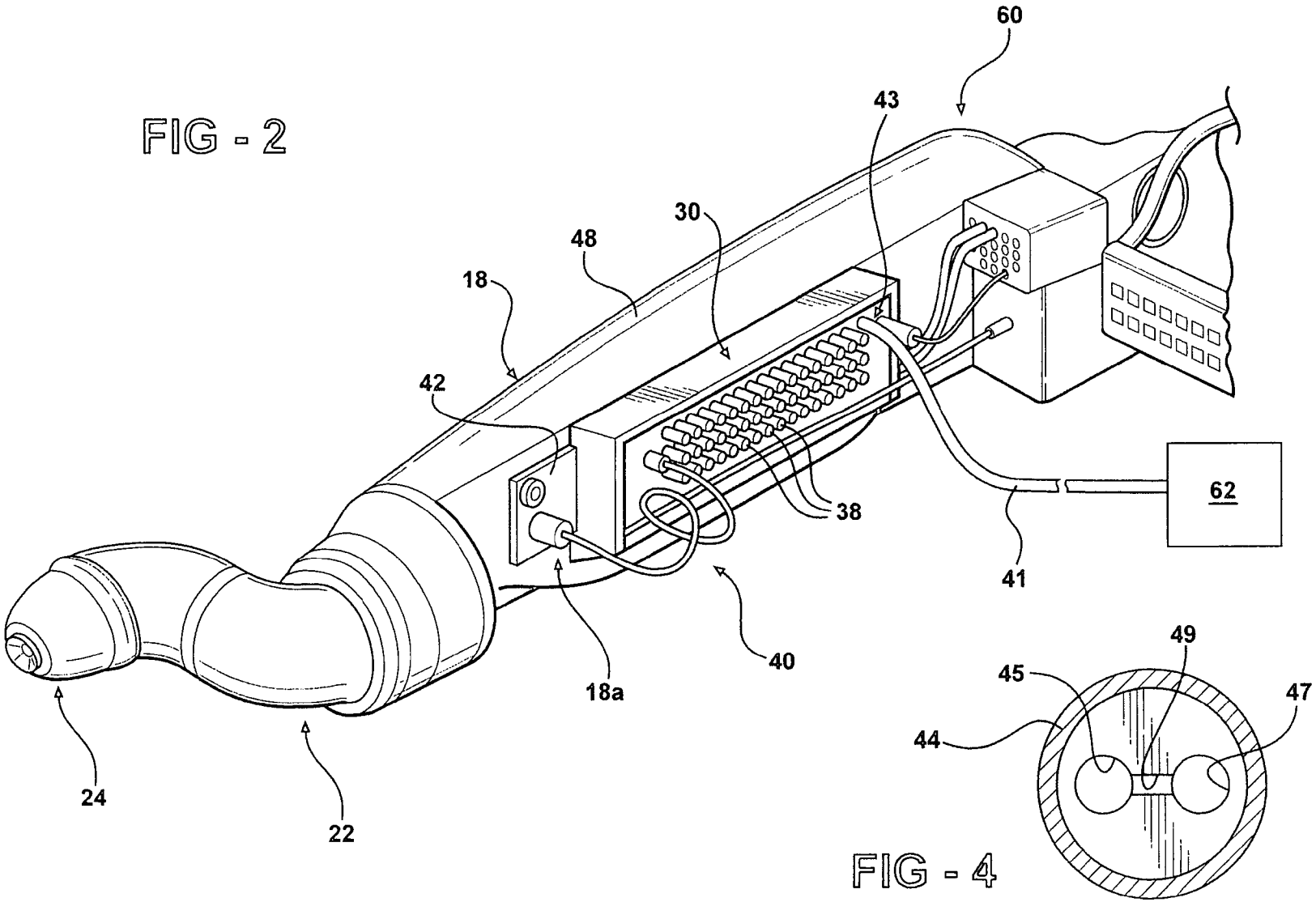
FIG. 2 is a perspective view of a first side of an outer arm of the painting robot of FIG. 1.
FIG. 4 is a cross-sectional top plan view of the canister of FIG. 3.

As shown in FIG. 2, the first side 18*a* of the outer arm 18 includes the color changer 30, an isolation line 40 that is electrostatically isolated from the electrically charged components of the painting system 10, a dump line 41, and a canister manifold 42. The color changer 30 includes a plurality of electrically grounded color valves 38. Each of the color valves 38 is disposed between a desired one of the paint lines 28 shown in FIG. 1 and the color changer 30. The isolation line 40 is connected to, and provides fluid communication between, an outlet of the color changer 30 and the canister manifold 42. The isolation line 40 is typically formed from fluorinated ethylene propylene (FEP) material. The dump line 41 provides fluid communication between an outlet 43 of the color changer 30 and a disposal system 62. The dump line 41 is connected to the color changer 30 upstream of the isolation line 40 and the color valves 38.

Figure 3:
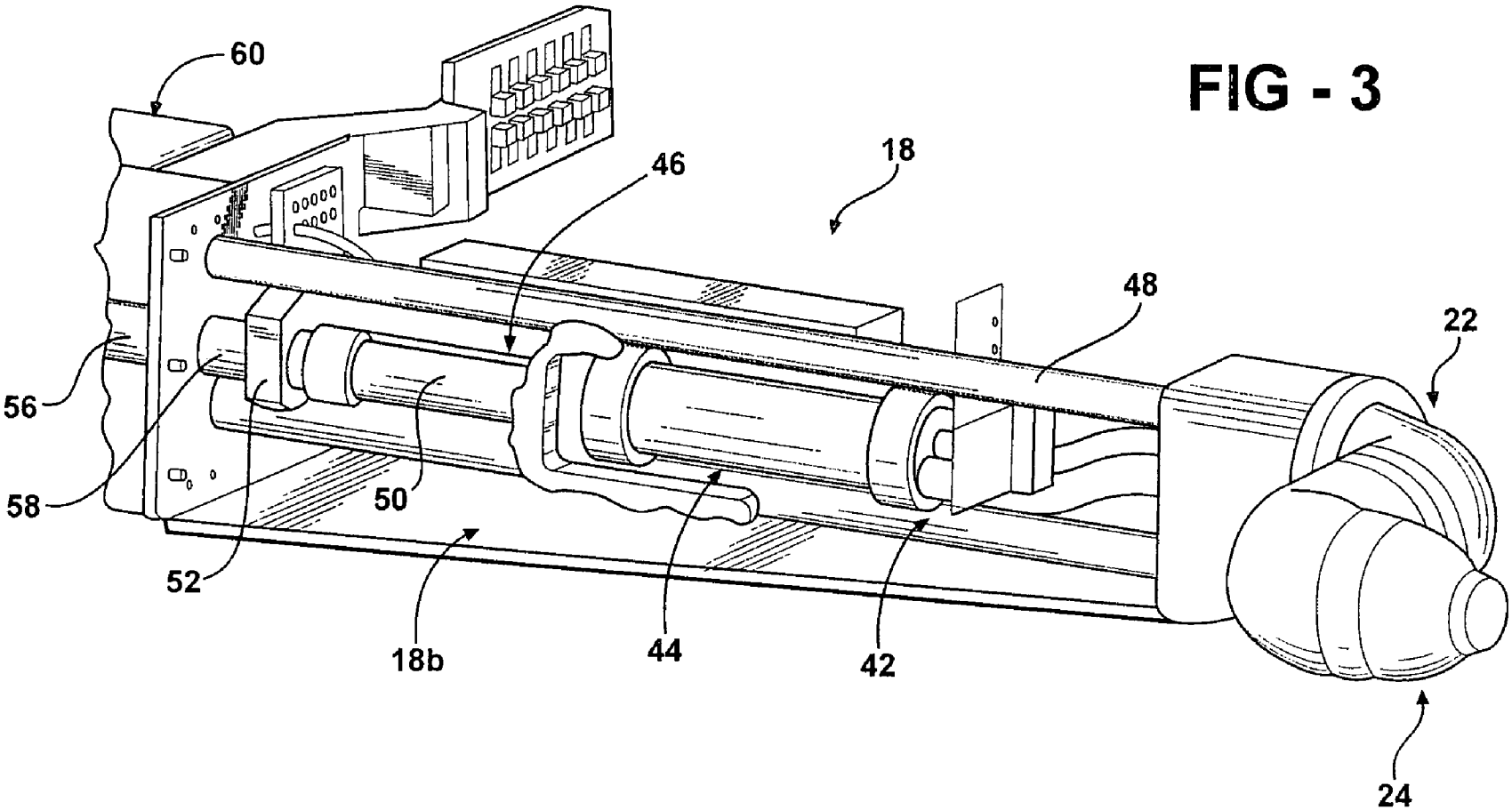
FIG. 3 is a perspective view of a second side of the outer arm of the painting robot of FIG. 1.

FIG. 3 illustrates the second side 18*b* of the outer arm 18. The second side 18*b* includes a canister 44 and a drive assembly. The canister 44 is in fluid communication with the canister manifold 42 and is electrically charged but electrostatically isolated from the grounded color valves 38 on the first side 18*a* of the outer arm 18 by an insulated housing 48. A first end of the canister 44 is disposed adjacent the wrist 22. As shown in FIG. 4 the first end of the canister 44 includes an inlet 45 in fluid communication with the canister manifold 42, an outlet 47 in fluid communication with the applicator 24, and a channel 49 formed therebetween in fluid communication with the inlet 45 and the outlet 47 of the canister 44. The channel 49 facilitates the flow of paint from the inlet 45 of the canister to the outlet 47 of the canister 44 and into the applicator 24 without withdrawing the piston 50 and introducing air to the canister 44.

Figure 5:
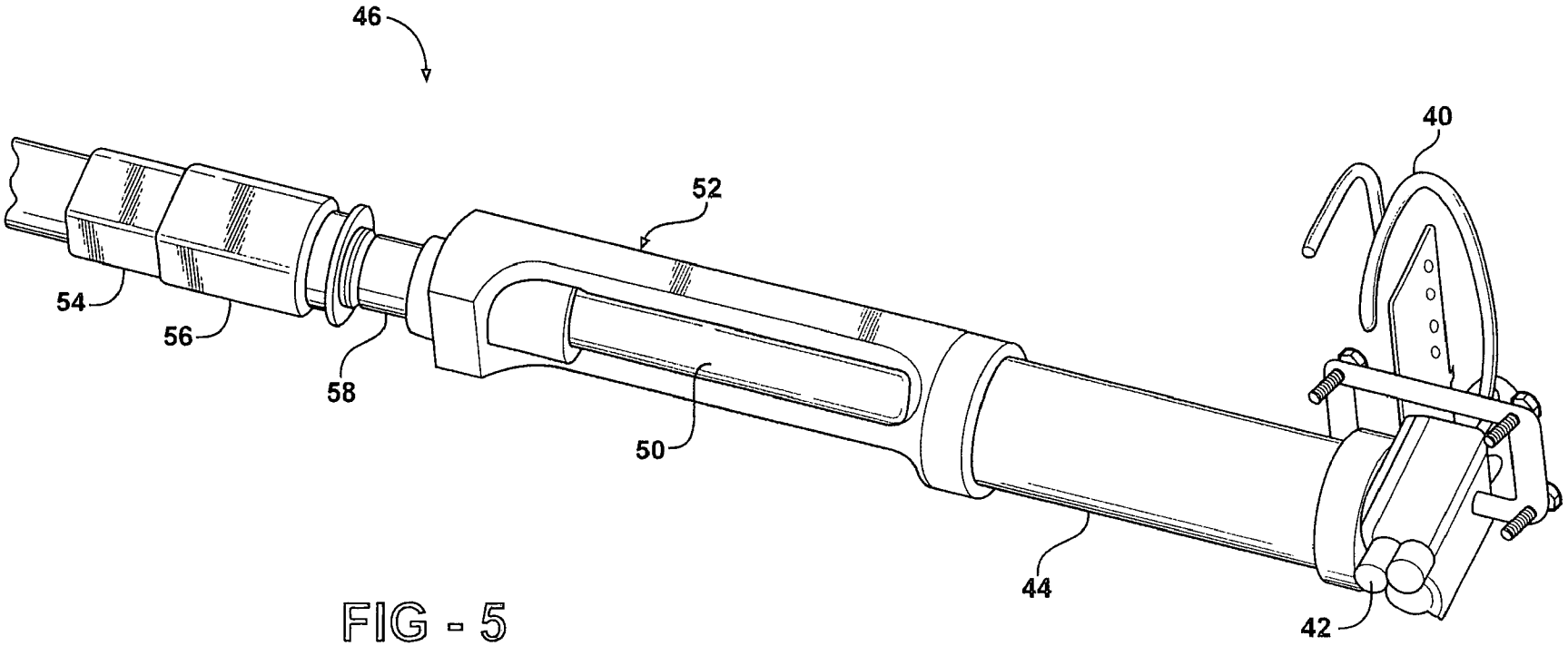
FIG. 5 is a perspective view of the canister and the drive assembly of FIG. 3.

The drive assembly 46 includes a piston ram 50 with a piston (not shown) slidably disposed in the canister 44 and operably connected to a drive bracket 52. As shown in FIG. 5, a drive motor 54 provides rotational motion to the piston ram 50 through a reducer 56 and a coupling 58. The piston ram 50 is a ball screw type drive utilized to dispense paint to the applicator 24 during a vehicle painting operation. A piston (not shown) of the piston ram 50 is moved longitudinally within the canister 44. Because the canister drive motor 54 and the reducer 56 are disposed in an elbow 60 connecting the outer arm 18 to the inner arm 12, the drive motor 54 is spaced from a high voltage cascade (not shown) adapted to electrostatically charge the paint in the canister 44.

As shown in FIG. 3, the wrist 22 is disposed on a second end of the outer arm 18 and includes the applicator 24 extending laterally outwardly therefrom. The applicator 24 extends in an axis parallel to the longitudinal axis of the outer arm 18. In the embodiment shown, the applicator 24 is a rotary bell applicator. The wrist 22 causes a rotation of the applicator 24 about the rotating axis 34 substantially parallel to a longitudinal axis of the outer arm 18, as shown in FIG. 1. The wrist 22 also facilitates a pivoting of the applicator 24 about the tilting axis 36 substantially perpendicular to the rotating axis 34. The wrist 22 and the applicator 24 are typically formed from a non-conductive material having suitable structural strength and impervious to the corrosive properties of solvents used in the painting process. An example of such a material is Lauramid A material. "Lauramid" is a registered trademark of Albert Handtmann ELTEKA Verwaltungs-GmbH of Biberach, Germany. Lauramid A material is a castable polyamide Nylon 12G material that also provides for electrostatic isolation, cleanliness, cleaning capability, and weight advantages.

To fill the painting system 10 in anticipation of the painting operation, a vacuum is generated in the isolation line 40 using the piston ram 50. An inlet valve (not shown) in communication with the canister 44 and the canister manifold 42 is opened. An outlet valve (not shown) in communication with the canister 44 and the applicator 24 is also closed. With the inlet valve opened and the outlet valve closed, the piston of the ram 50 is then drawn away from the first end of the canister 44 to generate the vacuum. The inlet valve is then closed and the outlet valve opened, thereby causing the piston of the ram 50 to be drawn towards the applicator 24 forcing air out of the canister 44 through the applicator 24. With air removed from the canister 44 the inlet is opened, paint is caused to flow from the bulk supply of paint through a desired paint line 28, through a desired color valve 38, through the color changer 30, through the isolation line 40, through the canister manifold 42, and into the canister 44. As the paint is caused to flow into the canister 44 through the inlet 45, paint flows through the channel 49 and to the outlet 47 to simultaneously fill the applicator 24 and the canister 44, without introducing air into the canister 44. Filling the canister 44 with paint after air is removed from the canister 44, and without introducing air back into the canister 44, eliminates the need for a bleed operation adapted to remove air from the painting system 10, thereby minimizing paint waste. A solvent may be caused to flow through the color changer 30 and the isolation line 40 to apply pressure on the paint flowing into the canister 44. The volumetric flow of solvent is controlled so that the solvent does not enter the canister 44. The level of intermixing of the paint and the solvent varies based on the viscosity of the paint, the viscosity of the solvent, the diameter of the isolation line 40 and other system lines, and the fill velocity of the paint and the solvent. To militate against an intermixing of the solvent and the paint, the viscosity of the solvent relative to the paint may be maximized. The benefit of applying a pressure on the paint using the solvent is that the isolation line and system lines are cleaned while the paint fills the canister 44, thereby minimizing the time between the filling operation and a cleaning operation. Additionally, as the viscosity of the solvent is increased and the intermixing is decreased, an amount of paint purged from the system during a change in paint color is minimized.

As the pressure increases in the canister 44 the paint exerts a force on the piston of the 50 and causes the piston to be moved away from the applicator 24. The pressure on the piston is sensed by the drive motor 54 as a torque feedback. Once a desired torque feedback indicating a filled canister 44 is reached, the inlet valve is closed. The desired torque feedback may be determined by measuring a change in the pressure within the canister 44. As the paint enters the canister 44, pressure gradually builds in the canister 44. When the paint has filled the available space, the rate of pressure building within the system increases. By observing the rate of change of the pressure build, the operator may determine when the canister 44 is filled with a desired amount of paint regardless of the viscosity or bulk supply pressure of the paint, thereby militating against time based filling operations and set torque feedback limits that lead to wasted paint from an extended filling operation or an improperly filled system from a shortened filling operation.

Measurement of the torque feedback allows an operator to determine both a negative torque (vacuum) generated during a cleaning operation and a positive torque (pressure) generated during a filling operation to ensure fill and cleaning operations proceed as desired. Furthermore, measurement of the torque feedback facilitates a diagnostic check of the painting system 10 for leaks. A variation in positive torque during filling operations of the painting system 10 over time, and a variation in negative torque during the cleaning operation of the painting system 10 over time, may indicate a leak in the painting system 10. If a leak is detected or the torque feedback is outside a desired value, the operator of the painting system 10 may initiate one of the following: a cleaning operation followed by a fill operation to obtain the desired torque feedback; a diagnostic test to generate information to the operator regarding malfunctioning system components; and a switch from the vacuum fill operation to a pressure fill through an injector fill operation as known in the art.

After the filling operation, the canister 44 is electrostatically charged and the painting operation is performed as known in the art. To clean the canister 44 of the painting system 10 after the painting operation, a solvent and air mixture is caused to flow through the canister manifold 42 and into the canister 44. The solvent and air mixture is then caused to backflow from the canister 44, through the isolation line 40, through the dump line 41, and to the disposal system 62. Accordingly, the dump line 41 is not in direct contact with the electrically charged canister 44. Further, the dump line 41 is disposed downstream from the canister 44 and the isolation line 40. Because the dump line 41 is isolated from the charged canister 44, electrostatic erosion caused by paint residue on the inner walls of the dump line 41 is not a primary concern.

Figure 6:
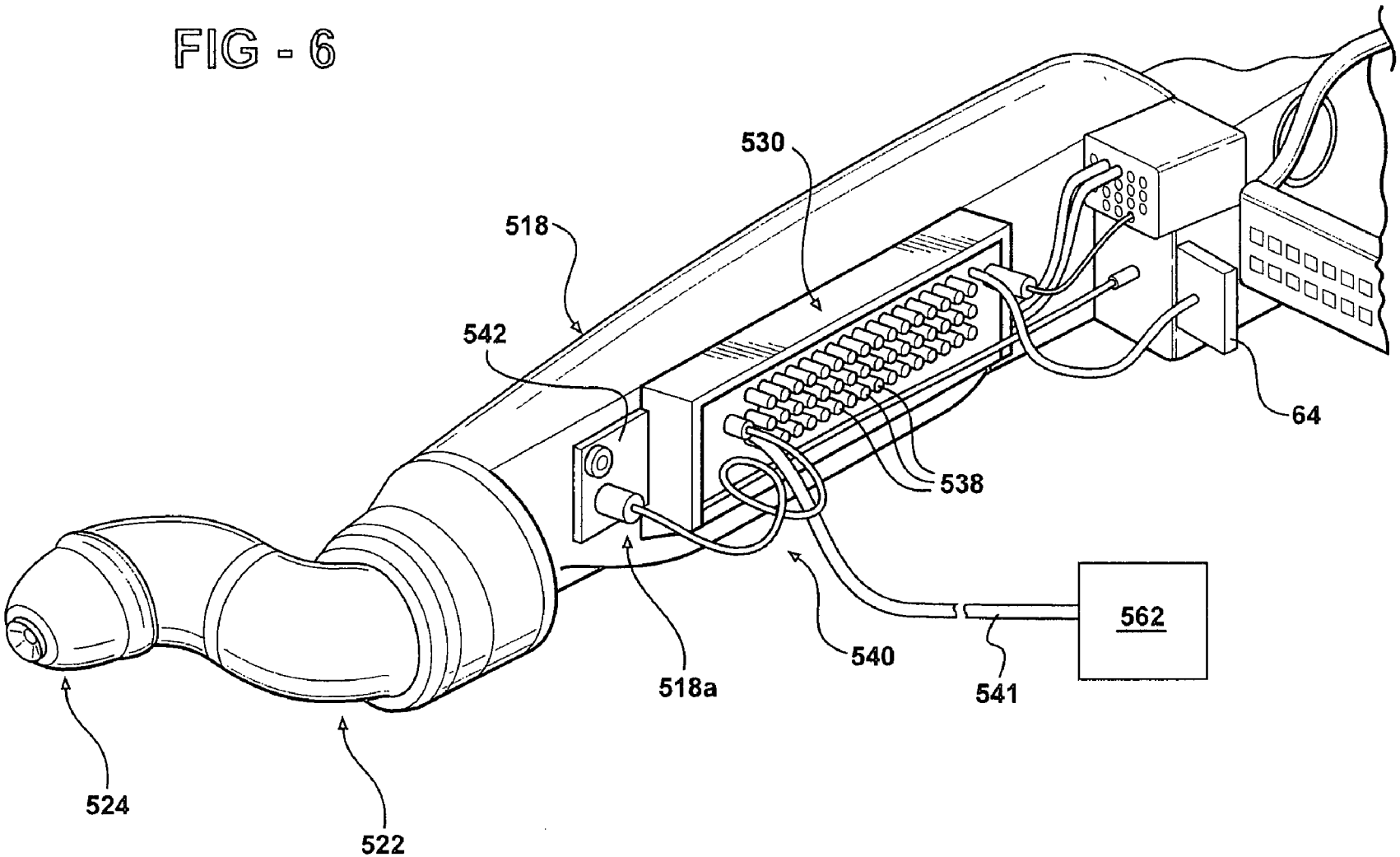
FIG. 6 is a perspective view of a first side of an outer arm of a painting robot according to another embodiment of the invention.

FIG. 6 shows a first side 518*a* of an outer arm 518 of a painting system according to another embodiment of the invention. The embodiment of FIG. 6 is similar to the painting system 10 and the outer arm of FIGS. 1 and 2 except as described below. Like the structure repeated from FIGS. 1 and 2 includes the same reference numerals preceded by the digit "5".

The outer arm 518 includes a color changer 530, an isolation line 540 in electrostatically isolated from the electrically charged components of the painting system, a dump line 541, a canister manifold 542, and a means for generating a vacuum 64. The color changer 530 includes a plurality of electrically grounded color valves 538 disposed on an exterior side surface of the first side 518*a* of the outer arm 518. Each of the color valves 538 is in fluid communication with an associated paint line. The isolation line 540 is connected to, and provides fluid communication between, an outlet of the color changer 530 and the canister manifold 542. The isolation line 540 is typically formed from fluorinated ethylene propylene (FEP). The dump line 541 provides fluid communication between the isolation line 540 and a disposal system 562. The dump line 541 is connected to the isolation line 540 upstream of a canister (not shown) disposed on a second side of the outer arm 518. A valve (not shown) disposed between the isolation line 540 and the dump line 541 facilitates the selective flow of fluid from the isolation line 540 and through the dump line 541. The canister manifold 542 is in fluid communication with the canister on the second side of the outer arm 518. In the embodiment shown, the means for generating a vacuum 64 is a venturi-type vacuum generator. However, the means for generating a vacuum 64 may be any conventional device adapted to generate a vacuum. The means for generating a vacuum 64 is connected to the first side 518*a* of the outer arm 518 adjacent to the color changer 530. The means for generating a vacuum is in fluid communication with the interior of the canister. It is understood that the means for generating a vacuum 64 may be disposed on another portion of the painting system or remotely disposed, as desired.

To fill the painting system in anticipation of a painting operation, a vacuum is generated in the canister by the means for generating a vacuum 64. An inlet valve (not shown) in communication with the canister and the canister manifold 542 and the means for generating a vacuum 64 is opened. An inlet valve in communication with the color changer 530 and the canister manifold 542 is closed. An outlet valve in communication with the canister and an applicator 524 is also closed. The means for generating a vacuum 64 is then caused to generate the vacuum in the canister, thereby drawing air from the canister as a piston slidably disposed in the canister is drawn towards a first end thereof. With the air removed from the canister the inlet valve in communication with the color changer 530 and the canister manifold 542 is opened, paint is caused to flow from the bulk supply of paint through the paint lines, through a desired color valve 538, through the color changer 530, through the isolation line 540, through the canister manifold 542, and into the canister. Filling the canister with paint after air is removed from the canister, and without introducing air back into the canister, eliminates the need for a bleed operation adapted to remove air from the painting system, thereby minimizing paint waste. Once the paint fills the flow path, the pressure in the canister increases. As the pressure increases in the canister, the paint exerts a force on the piston and causes the piston to be moved away from the first end of the canister. The pressure on the piston is sensed and a feedback is provided. Once a desired feedback indicating the canister is filled, the inlet valve is closed.

After the filling operation, the canister 44 is electrostatically charged and the painting operation, as known in the art, is performed. To clean the canister of the painting system after the painting operation, a solvent and air mixture is caused to flow through the canister manifold 542 and into the canister. The solvent and air mixture is then caused to flow from the canister, through the isolation line 540, through the valve disposed between the isolation line 540 and the dump line 541, through the dump line 541, and to the disposal system 562. Accordingly, the dump line 541 is not in direct contact with the electrically charged canister. Further, the dump line 541 is disposed downstream from the canister and the isolation line 540. Because the dump line 541 is isolated from the charged canister, the dump line 541 is not required to be thoroughly cleaned of paint residue to militate against electrostatic erosion caused by paint residue on the inner walls of the dump line 541.

Figure 7:
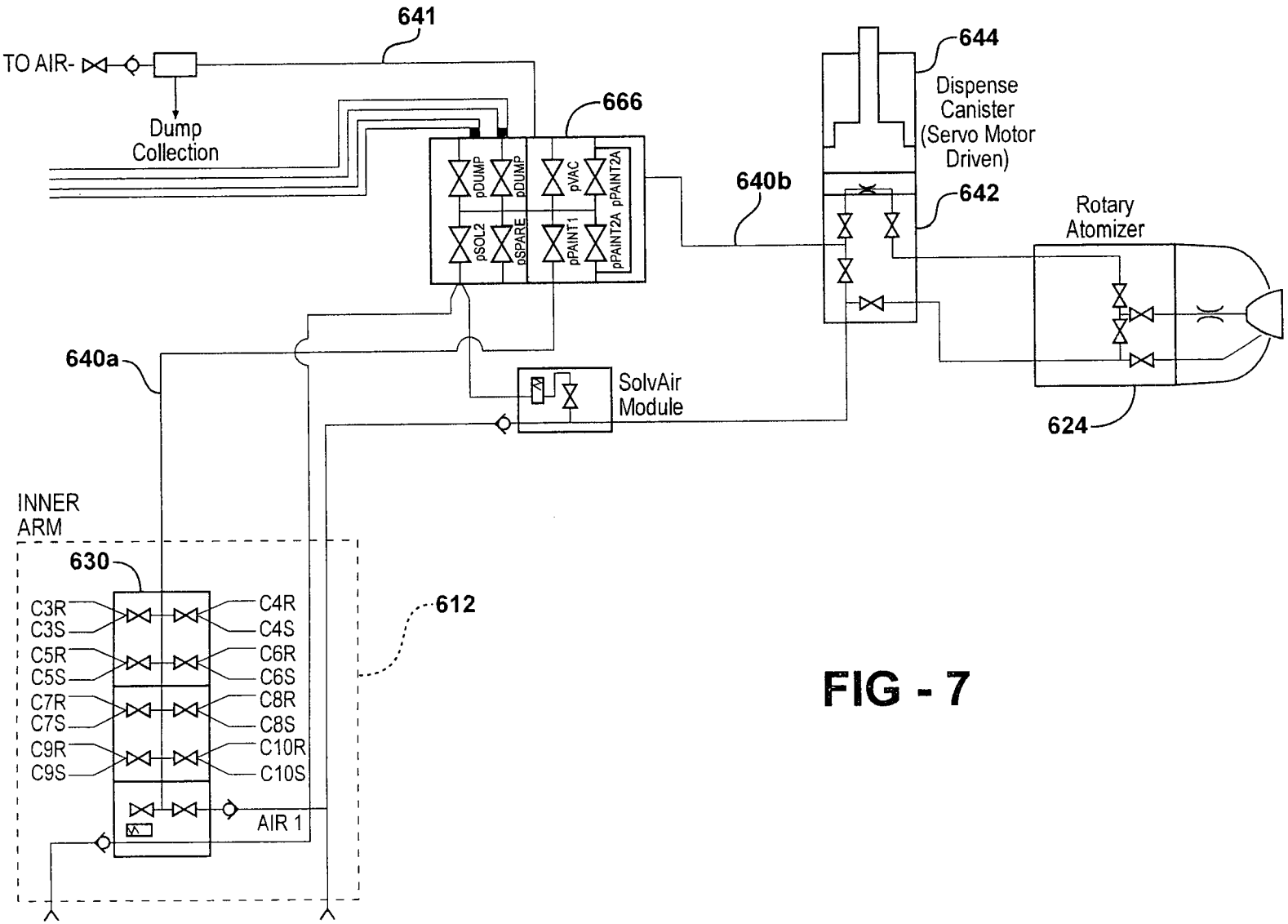
FIG. 7 is a fluidic schematic of third embodiment of a painting robot according the present invention.

FIG. 7 is a fluidic schematic of a third embodiment of a painting robot according the present invention wherein the distance between the color changer and the canister is longer than in the embodiments shown in FIGS. 1-6. For example, a color changer 630 can be mounted on an inner arm 612 instead of the outer arms 18 and 518. In this case, the isolation line can be split into a first portion 640*a* connecting the color changer 630 to an intermediate block 666, and a second portion 640*b* connecting the intermediate block 666 to a canister manifold 642 associated with a canister 644. A dump line 641 is connected to the color changer 630 through the intermediate block 666. The canister 644 supplies paint to a rotary atomizer applicator 624 as explained above with respect to the other embodiments. The intermediate block 666 can be mounted on the outer arm (not shown) for example.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A multi-axis painting robot system comprising:

a robot having an outer arm moveable within a spray booth;

an at least two-axis wrist with one end attached to the outer arm;

a paint applicator attached to an other end of said wrist;

a paint metering device mounted on the robot and in fluid communication with the paint applicator, the paint metering device in fluid communication with a paint supply valve; and a color changer mounted on the robot and in fluid communication with the paint metering device and the paint supply valve, wherein a vacuum is subjected to at least one of the internal passages of said paint applicator, said paint metering device, said color changer, and related fluid connections to remove an amount of air prior to opening the paint supply valve.

2. The system according to claim 1, wherein the paint metering device is a servo motor controlled paint canister.

3. The system according to claim 2, wherein a cleaning solvent and compressed air are supplied to a point of the fluid connection between the paint canister and the color changer, wherein said color changer has a dump valve such that said fluid connection can be cleaned and dried in a reverse direction of the paint supply to the canister for the purpose of electrostatic isolation.

4. The system according to claim 2, wherein the solvent is used to push paint from the color changer through the fluid connection in a direction of a paint supply to a canister inlet.

5. The system according to claim 2, wherein a channel is formed between an inlet hole and an outlet hole of the paint metering device such that a fluid path is formed when a canister piston is pushed fully forward.

6. The system according to claim 2, wherein an electrical feedback from the servo motor driving a piston is used to plot a positive force or a negative force on the piston with respect to time, wherein a slope of the feedback response is used to determine when the paint hits an injector tip, thereby indicating that the system is adequately primed prior to moving to a next step in a filling sequence.

7. The system according to claim 2, wherein an electrical feedback from the servo motor driving a piston is used to measure a positive force or a negative force on the piston, wherein the force feedback is used to confirm that a vacuum system is operating correctly.

8. The system according to claim 7, wherein in the event it is determined that the vacuum system is not operating correctly, the system includes a control system adapted to automatically switch from a vacuum priming mode to a pressure priming mode, wherein paint is pushed through the system until sensed at a fluid tip, in order to remove air and prime the system from a color changer to an applicator exit nozzle.

9. The system according to claim 1, wherein the paint metering device is a servo motor controlled gear pump.

10. The system according to claim 1, wherein the vacuum is generated by a venturi-type vacuum pump.

11. A multi-axis paint robot system comprising:

a robot having an outer arm moveable within a spray booth:

an at least two-axis wrist with one end attached to the outer arm;

a paint applicator attached to an other end of said wrist;

a paint metering device mounted on the robot and in fluid communication with the paint applicator, the paint metering device in fluid communication with a paint supply valve; and a color changer mounted on the robot and in fluid communication with the paint metering device, wherein cleaning solvent and compressed air are supplied to a location between a fluid connection of the paint metering device and the color changer, wherein said color changer has a dump valve such that said fluid connection can be cleaned and dried in a reverse direction of a paint supply to the paint metering device for the purpose of electrostatic isolation.

12. The system according to claim 11, wherein the paint metering device is a servo motor controlled paint canister.

13. The system according to claim 11, wherein a vacuum is subjected to internal passages of said paint applicator, said paint metering device, said color changer, and related fluid connections to remove an amount of air in the system prior to opening the paint supply valve.

14. The system according to claim 13, wherein the vacuum is generated by a venturi-type pump.

15. The system according to claim 11, wherein the solvent is used to push paint from the color changer through the fluid connection in a direction of a paint supply to a canister inlet.

16. The system according to claim 11, wherein a channel is formed between an inlet hole and an outlet hole of the paint metering device such that a fluid path is formed when a canister piston is pushed fully forward.

17. The system according to claim 11, wherein an electrical feedback from the servo motor driving a piston is used to plot a positive force or a negative force of the piston with respect to time, wherein a slope of the feedback response is used to determine when paint hits an injector tip, thereby indicating that the system is adequately primed prior to. moving to a next step in a filling sequence.

18. The system according to claim 11, wherein an electrical feedback from the servo motor driving a piston is used to measure a positive or negative force on the piston, wherein the force feedback is used to confirm that the vacuum system is operating correctly.

19. The system according to claim 18, wherein in the event it is determined that a vacuum system is not working adequately, a control system automatically switches from a vacuum priming mode to a pressure priming mode, wherein paint is pushed through the system until sensed at a fluid tip in order to remove air and prime the fluid path from the color changer to an applicator exit nozzle.

* * * * *